US010845089B2

(12) United States Patent
Le Coent et al.

(10) Patent No.: US 10,845,089 B2
(45) Date of Patent: Nov. 24, 2020

(54) HEATING UNIT FOR HEATING LIQUIDS IN A MOTOR VEHICLE

(71) Applicant: Eichenauer Heizelemente GmbH & Co. KG, Kandel (DE)

(72) Inventors: Patrick Le Coent, Neustadt (DE); Ulrich Schlachter, Herxheim (DE)

(73) Assignee: EICHENAUER HEIZELEMENTE GMBH & CO. KG, Kandel (DE)

( * ) Notice: Subject to any disclaimer, the term of this patent is extended or adjusted under 35 U.S.C. 154(b) by 359 days.

(21) Appl. No.: 15/896,045

(22) Filed: Feb. 13, 2018

(65) Prior Publication Data

US 2018/0231273 A1 Aug. 16, 2018

(30) Foreign Application Priority Data

Feb. 15, 2017 (DE) ..... 10 2017 103 039

(51) Int. Cl.

| | |
|---|---|
| ***F24H 3/04*** | (2006.01) |
| ***F24H 9/18*** | (2006.01) |
| ***F24H 9/20*** | (2006.01) |
| ***H05B 3/82*** | (2006.01) |

(52) U.S. Cl.

CPC ..... *F24H 3/0429* (2013.01); *F24H 9/1872* (2013.01); *F24H 9/2071* (2013.01); *H05B 3/82* (2013.01); *H05B 2203/02* (2013.01)

(58) Field of Classification Search

CPC .... F24H 3/0429; F24H 9/1872; F24H 9/2071; F24H 9/1827; H05B 3/82; H05B 2203/02

See application file for complete search history.

(56) References Cited

U.S. PATENT DOCUMENTS

| | | | | |
|---|---|---|---|---|
| 4,626,666 | A | 12/1986 | Maeda et al. | |
| 5,159,659 | A * | 10/1992 | Cameron | F24H 9/0047 219/548 |
| 5,633,978 | A | 5/1997 | Hofsaess | |
| 6,847,017 | B2 | 1/2005 | Starck et al. | |
| 2016/0360573 | A1 * | 12/2016 | Bohlender | H05B 3/18 |

FOREIGN PATENT DOCUMENTS

| | | |
|---|---|---|
| DE | 34 40 166 A1 | 5/1985 |
| DE | 248 016 A1 | 7/1987 |
| DE | 44 05 040 A1 | 8/1995 |
| EP | 1 414 275 A1 | 4/2004 |

* cited by examiner

*Primary Examiner* — Janie M Loeppke
(74) *Attorney, Agent, or Firm* — Hackler Daghighian Martino & Novak

(57) ABSTRACT

A heating unit for the heating of liquids in a motor vehicle has one or more PTC-heating elements between two heat-conducting plates then between a multi-part plastic housing. The two heat-conducting plates each have a base section against the one or more PTC-heating elements and each have an arm adjacent to the base section. An insulating element is arranged between the arms of the two heat-conducting plates, where the plastic housing has a first housing part and a second housing part. The first housing part has at least one pocket into which an arm of the heat-conducting plates and interposed insulating element is inserted. The first housing part and the second housing part together form a heating chamber adjacent to the at least one pocket, in which are arranged the base sections of the heat-conducting plates and the at least one PTC-heating element which is interposed between them.

12 Claims, 4 Drawing Sheets

HEATING UNIT FOR HEATING LIQUIDS IN A MOTOR VEHICLE

CROSS-REFERENCE TO RELATED APPLICATIONS

This application claims priority to German Patent Application No. 10 2017 103 039.5, filed Feb. 15, 2018, the entire contents of which are hereby incorporated by reference.

DESCRIPTION

Field of the Invention

The application relates to a heating unit for the heating of liquids in a motor vehicle, wherein the heating unit comprises at least one PTC-heating element and two heat-conducting plates, between which the PTC-heating element is arranged.

Background of the Invention

A heating unit for the heating of liquids is of known from EP 1 414 275 B1. The said heating unit has two heat-conducting elements, which forward heat generated by a PTC-element to a cartridge-like housing, in that arms of the heat-conducting elements press resiliently fit against the inner face of a metal housing. The heat transfer elements themselves generate a contact pressure by virtue of their elastic shape.

The disadvantage here, however, is that the cylindrical housing has only a relatively small surface area and its shape cannot be variably configured. For the heating of a liquid in a larger tank, which also requires a larger surface area for the transfer of heat from the heating unit to the liquid, this design is therefore rather unsuitable. This is all the more the case if the housing to be used is not a metal housing, but rather a cheaper plastic housing that can be flexibly manufactured, but has poor heat-conducting properties. Heating units with a plastic housing are, however, particularly advantageous for use in the heating of corrosive liquids in motor vehicles, as is the case, for example, with the reducing agent tank of SCR-systems.

An object is therefore that of developing a heating unit, which is protected by a plastic housing from a corrosive liquid, and at the same time has the largest possible heat exchange surface area, but nevertheless calls for the smallest possible volume. In the case of a tank heater for a reducing agent system, the tank heater should be able to thaw frozen reducing agent over a larger region as quickly as possible, including the region of the suction opening.

SUMMARY OF THE INVENTION

This object is achieved by a heating unit with the features of claim 1. Advantageous refinements are the subject of the dependent claims and the following description.

A heating unit in accordance with the invention has a multi-part plastic housing, in which are arranged two heat-conducting plates, each having a base section and at least one arm adjacent to the base section. The base sections of the two heat-conducting plates, together with at least one PTC-heating element located between them, are arranged in a heating chamber of the plastic housing. In each case two arms of the heat-conducting plates, together with an interposed insulating element, are arranged in a housing pocket, which is adjacent to the heating chamber. The plastic housing can have one or more housing pockets. Here the first part of the housing can form the pockets and a floor of the heating chamber. The second part of the housing, acting as a cover, can then close off the heating chamber and the pockets. Both the first and second parts of the housing can be assembled in each case from a plurality of parts, but are preferably monolithic in each case, so that the housing is preferably a two-part housing.

In order to ensure good heat transfer from the heat-conducting plates via the pocket sidewalls to the adjacent liquid that is to be heated, opposing sidewalls of the pocket can press against the arms of the heat-conducting plates. A stack formed by the arms and the interposed insulating element is thus clamped in the pocket. The outer surfaces of the heat-conducting plates can, for example, be elastically preloaded against the inner face of the pocket sidewalls that is located opposite to the former in each case. The pockets are preferably widened as a result of the insertion of the arms of the heat-conducting plates, together with the interposed insulating element, that is to say, they are stretched elastically. For this purpose, one or both sidewalls, which face the arms in a planar manner, can be provided with an inwardly directed curvature. Another possibility is for the interior of the pocket to taper towards its end facing away from the heating chamber; it preferably tapers in a wedge shape and thus increases the contact pressure during the insertion.

In an alternative embodiment, the insulating element is made of an elastically compressible material. As a result of an oversizing of the heat-conducting plates and insulating element that is present in the unloaded state, the heat-conducting plates, in the installed compressed state of the insulating element, are pressed against the inner faces of the pocket.

It is also possible for the heat-conducting plates themselves to produce the elastic preload against one another. By suitable shaping of the heat-conducting plates, the preloading, e.g. by screwing, of the heat-conducting plates with the one or more PTC-heating elements then generates in the region of the pockets a spreading of the arms of the heat-conducting plates against one another, and thus a pressing of the heat transfer elements against the inner faces of the pockets.

The two heat-conducting plates preferably also serve to make electrical contact with the at least one PTC-heating element, for example, in that in each case a terminal pin of an electrical connector is attached to one of the two heat-conducting plates.

If a number of heating elements are present, the heating elements can also be connected to separate heat-conducting plates. Thereby individual regions of a heating unit can be heated separately to different levels, for example, different pockets of the plastic housing.

In an advantageous refinement, the at least one heating element is designed as a ceramic PTC-heating element, for example one based on barium titanate. By virtue of their resistance-temperature characteristics, ceramic PTC-heating elements can be described as intrinsically safe heating elements. On the other hand, however, a high heat output can only thereby be guaranteed if good heat dissipation is ensured.

In an advantageous refinement the two heat-conducting plates are clamped together in the immediate vicinity of the interposed PTC-heating element with the aid of a screwed joint. However, other clamping joints such as, for example, a riveted joint, are also possible. The PTC-heating element is preferably configured so as to be annular, which enables a central clamped joint.

Here a connecting element that protrudes through the PTC-heating element, such as a screw or a rivet, is preferably electrically insulated from at least one of the two heat-conducting plates by an insulating sleeve. The connecting element can have an additional spring element, so that the two heat-conducting plates are pressed against the one or more PTC-heating elements even more reliably.

In a preferred embodiment, the heat-conducting plates are also essentially U-shaped in design with two arms and a connecting base section, wherein in each case one arm of the heat-conducting plates is accommodated in a plastic pocket and at least one heating element is arranged on, in particular is clamped against, the base between the two heat-conducting plates. However, alternative configurations, such as a double U-shaped, an H-shaped, or even pockets arranged in a circle, are also possible.

Advantageously, a large heat exchange surface area is provided by such an easy-to-design shape. In fact, while the heat-conducting plates are pressed within the pockets by the elastic preload against the inner sides of the pockets, a good transfer of heat is provided from the one or more heating elements onto the heat-conducting plates in the region outside the pockets by the clamping of the heating element between the base sections of the heat-conducting plates.

In a further advantageous refinement of the invention provision is made for the two heat-conducting plates each to carry an electrical terminal pin, wherein the electrical terminal pins are in each case attached to an attachment region of one of the two heat-conducting plates, which is located opposite a recess of the respectively other heat-conducting plate, and is formed as a depression pressed into this recess, such that the two attachment regions of the heat-conducting plates are arranged essentially in one plane, and the two terminal pins have the same length. In this manner it is possible to simplify the electrical connection. The terminal pins can be attached to the arms, but are preferably provided on the base sections of the heat-conducting plates, in particular on a part of the base sections, between which no PTC-heating elements are arranged.

In a refinement of the invention, the heating unit, with the exception of the region around the electrical connecting leads, is completely surrounded by a plastic housing. Here the plastic housing is of a multi-part design, preferably a two-part design, wherein the housing parts are tightly joined, in particular are welded together. The one or more heating elements are thus arranged so as to be well protected against corrosive liquids inside the interior of the plastic housing. In an advantageous embodiment, the plastic housing is in turn tightly joined, in particular welded, to a tank, for example a reducing agent tank. By this means the plastic housing particularly advantageously tightly seals an opening in the tank, wherein the connecting leads of the heating unit arranged in the plastic housing protrude through the opening onto the exterior of the tank.

The opening preferably comprises just the immediate region of the electrical connections. By this means almost the entire outer region of the plastic housing can be in heat-conducting contact with the heating liquid and can form the largest possible heat exchange area. For this purpose, not only are the inner faces of the pockets advantageously manufactured so as to be undersized in at least some regions, before the introduction of the heating package, but the same is true also for opposing inner faces of the plastic housing in the region of the base.

BRIEF DESCRIPTION OF THE DRAWINGS

Further advantages of the invention ensue from the claims and the accompanying figures and their description, in which embodiments of the inventive heating unit are illustrated. Here:

DETAILED DESCRIPTION OF THE PREFERRED EMBODIMENTS

Figure 1:
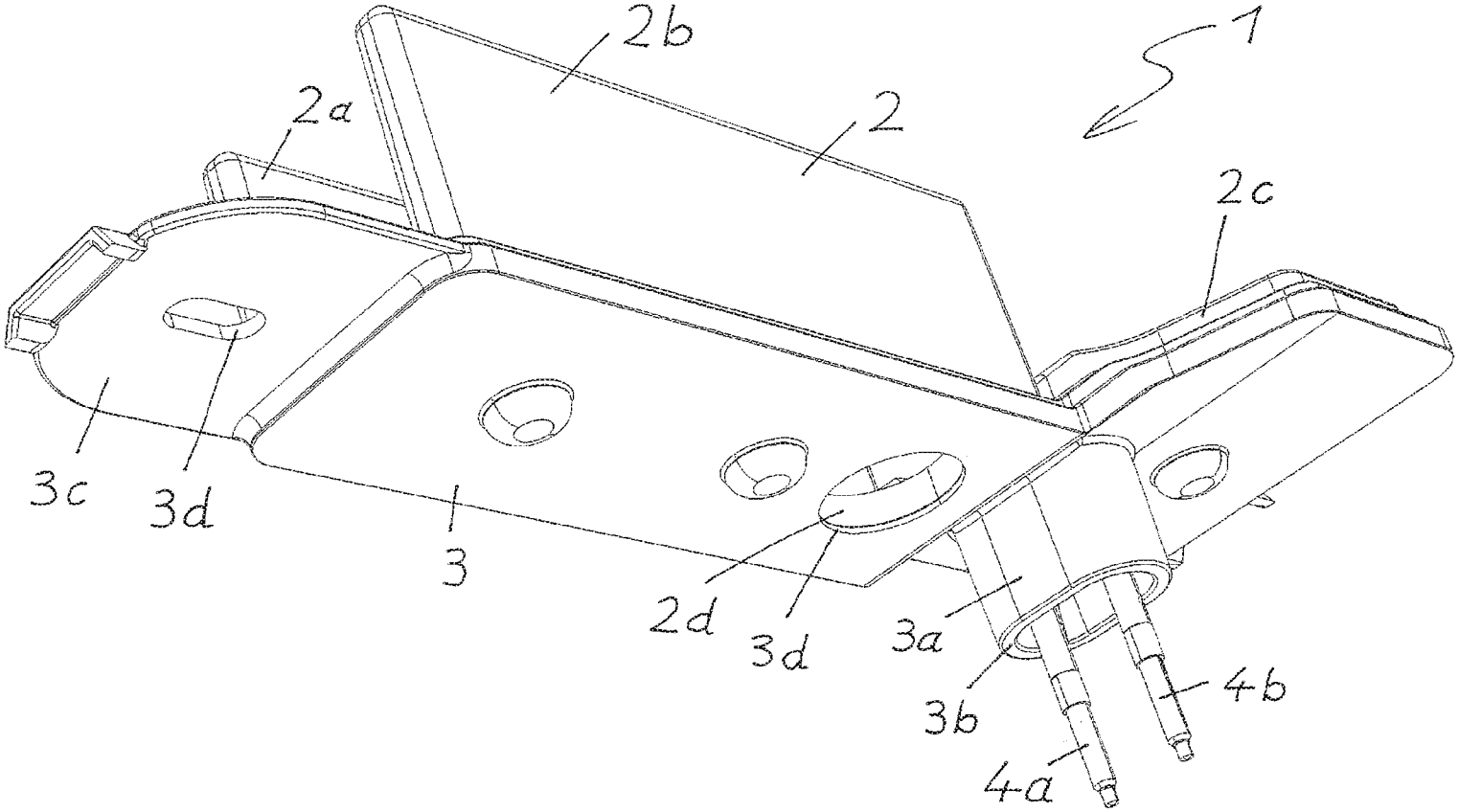
FIG. 1 shows an overall view of a heating unit in perspective.

FIG. 1 shows an overall view in perspective of an embodiment of the inventive heating unit 1. What is shown is the two-part plastic housing 2, 3 with the two protruding terminal pins 4*a*, 4*b* as the electrical connecting leads of the ceramic PTC-heating elements arranged in the interior. The lower part of the housing 2 has a base plate 2*c* and two pockets 2*a*, 2*b* arranged essentially at right angles to the latter. On the upper part of the housing 3 is formed an annular ring 3*a* with passage openings for the terminal pins 4*a* and 4*b*. Furthermore, an attachment tab 3*d* is provided with an aperture 3*c* for an attachment element, such as a screw or rivet, for purposes of attaching the heating unit 1 to a housing or tank. Furthermore, the two parts of the housing 2, 3 can have a congruent opening 2*d*, 3*d*, for example, for the case in which the heating unit 1 serves to heat a reducing agent tank, and a suction line (not shown) is then arranged there, preferably together with a filter unit. Advantageously, the region around the suction line can then also be heated at the same time.

Figure 2:
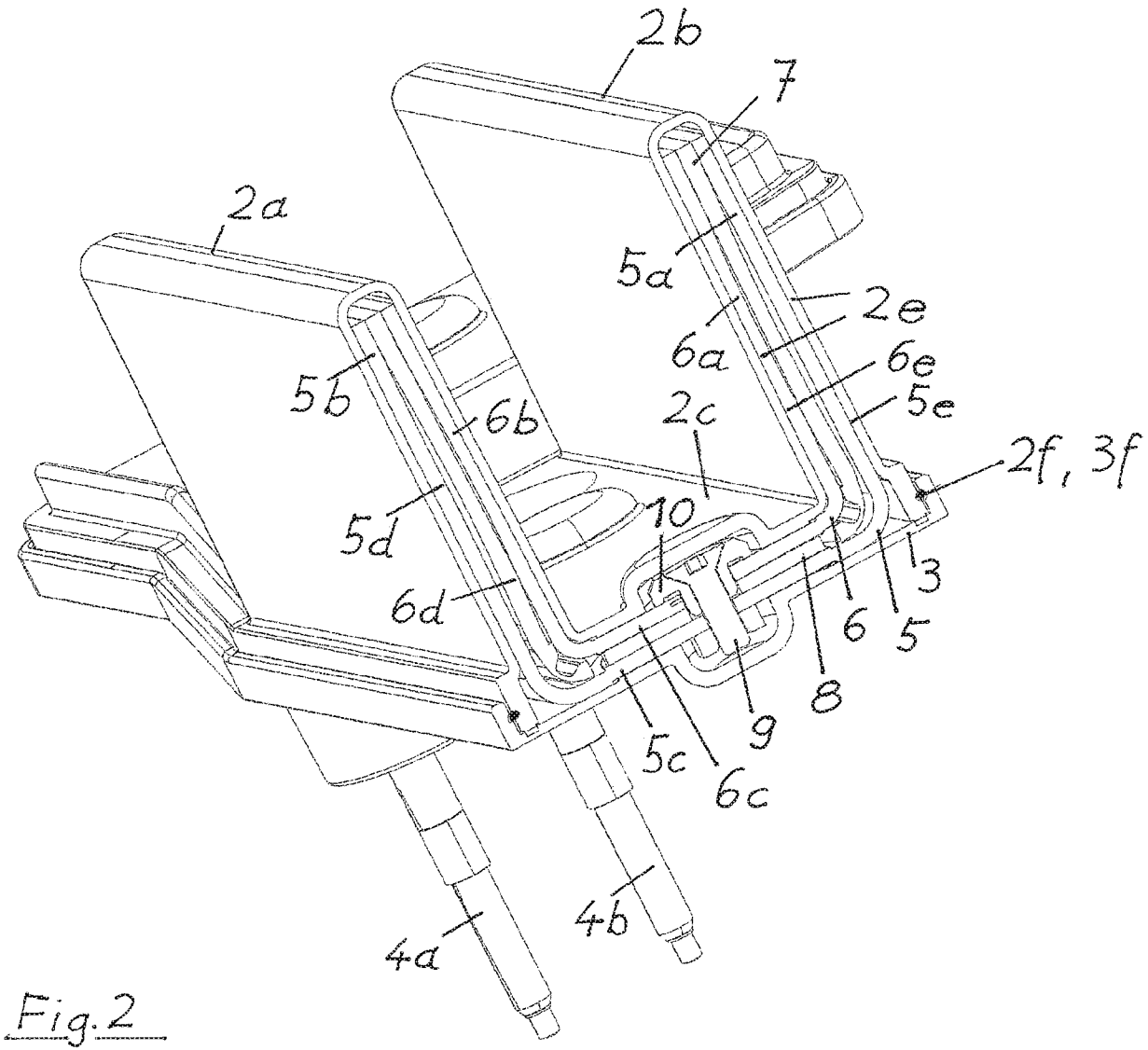
FIG. 2 shows a cross-section through the heating unit in the region around a heating element.

FIG. 2 shows a sectional view through the heating unit 1, wherein two heat-conducting plates 5, 6 are arranged in the interior. They have an essentially U-shaped configuration with two arms 5*a*, 5*b* and 6*a*, 6*b* respectively, and a connecting base section 5*c* and 6*c* respectively. They are located with their inner surfaces 5*d*, 6*d* opposed. An insulating element 7 is arranged between the arms 5*a*, 6*a* and 5*b*, 6*b*, and at least one PTC-heating element 8 is arranged between the base sections 5*c*, 6*c*.

The pockets 2*a*, 2*b* of the plastic housing are widened during insertion of the arms 5*a*, 6*a* and 5*b*, 6*b*, so that the side walls 2*e* of the pockets 2*a*, 2*b*, which face the arms in a planar manner, press against the arms 5*a*, 6*a* and 5*b*, 6*b* with a clamping action. For this purpose, the interiors of the pockets 2*a*, 2*b* can be designed so as to taper towards their free ends, i.e. the distance between the inner sidewalls 2*e* reduces in this direction. Another possibility is an inwardly directed bulging of one or both side walls 2*e* of the pockets 2*a*, 2*b*, or an oversizing of a package formed by the arms 5*a*, 6*a*, 5*b*, 6*b* and the insulating element 7, compared with the distance between the side walls 2*e* of the pockets 2*a*, 2*b* facing the arms 5*a*, 6*a*, or 5*b*, 6*b* respectively.

The two halves of the housing 2, 3 are tightly joined, preferably welded, to one another all the way round by a circumferential joint line 2*f*, 3*f*.

In this illustrative embodiment the two heat-conducting plates 5, 6 are heated by one or more PTC-heating elements 8, which are arranged between the base sections 5*c*, 6*c* outside of the pockets 2*a*, 2*b*. The heat-conducting plates 5, 6 form the two electrical connection faces for all PTC-heating elements 8. The PTC-heating elements 8 can be arranged in an annular manner, or can have an annular shape. The PTC-heating elements are clamped between the heat-conducting plates 5, 6 with the aid of a screw-nut joint 9, which protrudes through corresponding apertures of the heat-conducting plates 5, 6. If an annular PTC-heating element 8 is present, the screw can protrude through the opening of the PTC-heating element. The screw 9 is electrically insulated from the heat-conducting plate 6 by an insulating sleeve 10. In addition, a spring element in the connection area can increase the contact pressure further.

Figure 3:
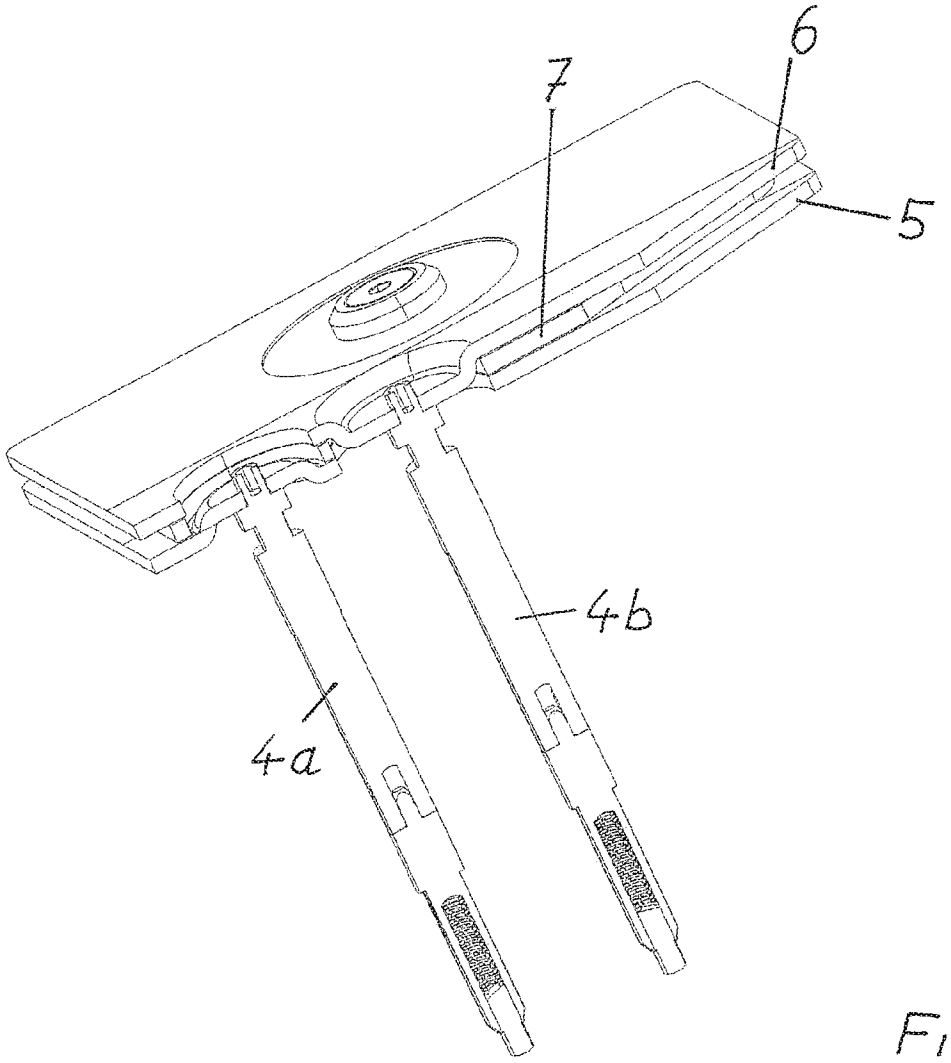
FIG. 3 shows a detail view of the heat-conducting plates in the region around the electrical terminal connections.

FIG. 3 shows a section through the base of the heating unit without the housing in the region around the electrical terminal pins 4*a*, 4*b*. In a limited region around their respective pins 4*a*, 4*b* each heat-conducting plate 5, 6 is pressed onto the other heat-conducting plate, and in a further limited region is cut out around the joint with the other heat-conducting plate. The interposed insulating element 7 is likewise cut out in the region of the terminals. By this means, both terminal pins 4*a*, 4*b* can advantageously be attached onto the heat-conducting plates 5, 6 in the same plane, preferably by riveting.

Figure 4:
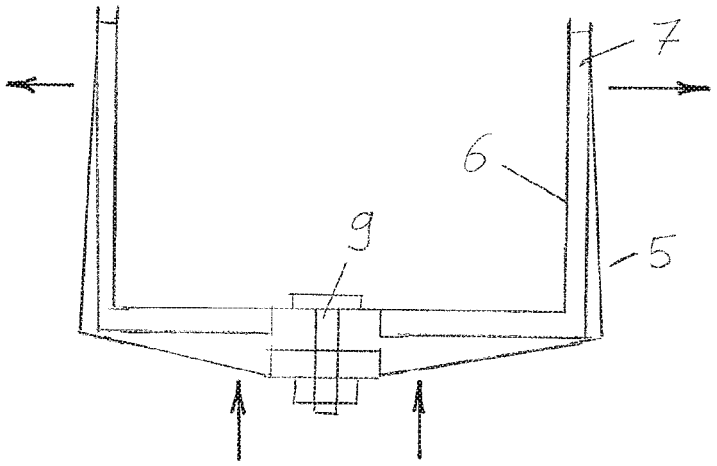
FIG. 4 shows an alternative embodiment of the heating unit with heat-conducting plates that can be elastically preloaded.

FIG. 4 shows very schematically another embodiment variant in which the heat-conducting plates 5, 6 press against the side walls of the pockets, not by virtue of undersizing the pocket side walls, but rather as a result of the elastic configuration of the heat-conducting plates 5, 6 themselves. In the variant of this principle that is illustrated, the distance between the two heat-conducting plates 5, 6 in the region of the one or more PTC-heating elements 8 in the unloaded state is significantly larger than in the installed state. After the clamping of the heating elements 8, the distance between the outer surfaces 5*e*, 6*e* of the heat-conducting plates 5, 6 in the region of the pockets is increased in relation to the unloaded state. If this distance is greater than the distance between the pocket sidewalls, the heat-conducting plates 5, 6 in the installed state are elastically preloaded against the pocket sidewalls 2*e*.

Other variants of the inventive heating unit are also conceivable.

Figure 5:
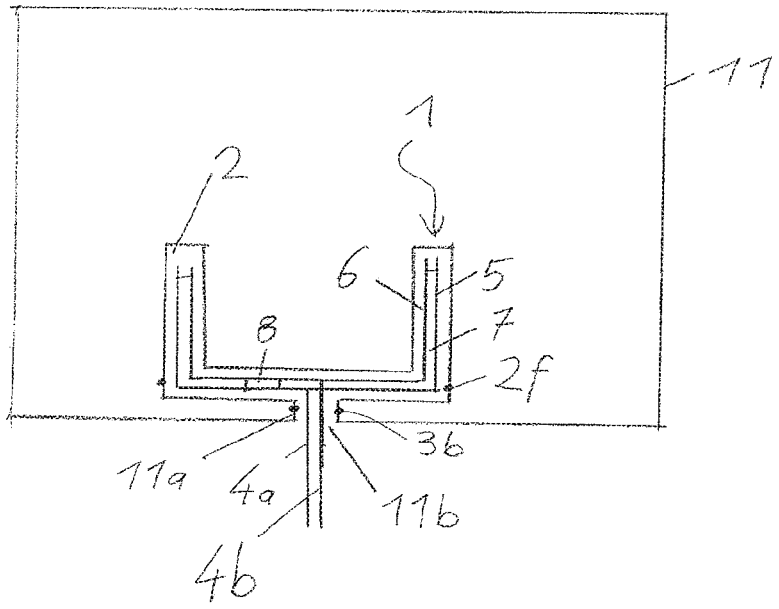
FIG. 5 shows a schematic view of an inventive heating unit in a tank.

In FIG. 5 a heating unit 1 is shown very schematically, installed in a tank 11. Only the parts that are essential to the illustration of the sealed arrangement of the heating unit 1 in the tank 11 are indicated. The other structural elements of the heating unit 1 can be taken from the earlier figures and description. By virtue of the sealed joint 2*f*, in particular a welded joint, the housing is sealed relative to the liquid to be heated, apart from in the region around the joint. In the region around the joint the outer edge 3*b* of the annular ring 3*a* is likewise tightly sealed, preferably by welding, against a corresponding annular shoulder 11*a* of the tank. Inside the annular shoulder, the terminal connections 4*a*, 4*b* are thus led out of the tank 11, sealed against the liquid.

Also clearly visible is the large heat exchange surface area of the heating unit in the tank. Since at least in the region around the pockets, the heat-conducting plates are preloaded against the pocket side walls, a particularly high rate of heat transfer is provided here. But even in the base region the heat-conducting plates 5, 6 fit against the housing inner walls and thus transfer heat from both sides to the adjacent liquid. By the arrangement of the one or more PTC-heating elements only in the lower base section, adjacent to the bottom of the tank, reliable operation with a high heat output is ensured, even when the level of the liquid is low.

LIST OF REFERENCE SYMBOLS

1 Heating unit
2 Lower part of the plastic housing
2*a* Pocket
2*b* Pocket
2*c* Base plate
2*d* Opening
2*e* Sidewall
2*f* Joint
3 Upper part of the plastic housing
3*a* Annular ring
3*b* Attachment tab
3*c* Aperture
3*d* Opening
4*a* Terminal pin
4*b* Terminal pin
5 Heat-conducting plate
5*a* Arm
5*b* Arm
5*c* Base section
5*d* Inner surface
6 Heat-conducting plate
6*a* Arm
6*b* Arm
6*c* Base section
6*d* Inner surface
7 Insulating element
8 PTC-heating element
9 Screw
10 Insulating sleeve
11 Tank
11*a* Annular shoulder

What is claimed is:

1. A heating unit for the heating of liquids in a motor vehicle, comprising:

one or more PTC-heating elements;

two heat-conducting plates, between which the one or more PTC-heating elements are arranged; and a multi-part plastic housing, in which the heat-conducting plates and the one or more PTC-heating elements are arranged;

wherein the two heat-conducting plates each have a base section, which contacts the one or more PTC-heating elements, and each have an arm, which is adjacent to the base section, wherein an insulating element is arranged between the arms of the two heat-conducting plates;

wherein the plastic housing comprises a first housing part and a second housing part, wherein the first housing part has at least one pocket, in which an arm of each of the heat-conducting plates, together with the interposed insulating element is inserted, and the first housing part and the second housing part together form a heating chamber adjacent to the at least one pocket, in which the base sections of the heat-conducting plates and the at least one PTC-heating element located between them, are arranged;

wherein opposing side walls of the at least one pocket press against the arms of the heat-conducting plates.

2. The heating unit according to claim 1, wherein the two heat-conducting plates are pressed against the at least one PTC-heating element by means of a screw, which protrudes through the base sections and engages with a nut.

3. The heating unit according to claim 2, wherein the screw is surrounded by an insulation sleeve.

4. The heating unit according to claim 1, wherein the two heat-conducting plates each carry an electrical terminal pin, wherein the electrical terminal pins are in each case attached to an attachment region of one of the two heat-conducting plates, which is located opposite a recess of the respectively other heat-conducting plate and is formed as a depression pressed into this recess, so that the two attachment regions of the heat-conducting plates are arranged essentially in one plane, and the two terminal pins have the same length.

5. The heating unit according to claim 4, wherein the attachment regions are arranged in the heating chamber.

6. The heating unit according to claim 1, wherein the at least one pocket runs transverse to the heating chamber.

7. The heating unit according to claim 1, wherein the arms of the two heat-conducting plates at their ends adjacent to the base section have a greater distance from one another than at their free ends.

8. The heating unit according to claim 1, wherein the first housing part is formed from at least two pockets, in each of which is inserted an arm of the two heat-conducting plates, together with the interposed insulating element.

9. The heating unit according to claim 1, wherein the first part of the housing has a base plate, which forms a floor of the heating chamber.

10. A heating unit for the heating of liquids in a motor vehicle, comprising:

one or more PTC-heating elements;

two heat-conducting plates, between which the one or more PTC-heating elements are arranged; and a multi-part plastic housing, in which the heat-conducting plates and the one or more PTC-heating elements are arranged;

wherein the two heat-conducting plates each have a base section, which contacts the one or more PTC-heating elements, and each have an arm, which is adjacent to the base section, wherein an insulating element is arranged between the arms of the two heat-conducting plates;

wherein the plastic housing comprises a first housing part and a second housing part, wherein the first housing part has at least one pocket, in which an arm of each of the heat-conducting plates, together with the interposed insulating element is inserted, and the first housing part and the second housing part together form a heating chamber adjacent to the at least one pocket, in which the base sections of the heat-conducting plates and the at least one PTC-heating element located between them, are arranged;

wherein the two heat-conducting plates each carry an electrical terminal pin, wherein the electrical terminal pins are in each case attached to an attachment region of one of the two heat-conducting plates, which is located opposite a recess of the respectively other heat-conducting plate and is formed as a depression pressed into this recess, so that the two attachment regions of the heat-conducting plates are arranged essentially in one plane, and the two terminal pins have the same length.

11. The heating unit according to claim 10, wherein the attachment regions are arranged in the heating chamber.

12. A heating unit for the heating of liquids in a motor vehicle, comprising:

one or more PTC-heating elements;

two heat-conducting plates, between which the one or more PTC-heating elements are arranged; and a multi-part plastic housing, in which the heat-conducting plates and the one or more PTC-heating elements are arranged;

wherein the two heat-conducting plates each have a base section, which contacts the one or more PTC-heating elements, and each have an arm, which is adjacent to the base section, wherein an insulating element is arranged between the arms of the two heat-conducting plates;

wherein the plastic housing comprises a first housing part and a second housing part, wherein the first housing part has at least one pocket, in which an arm of each of the heat-conducting plates, together with the interposed insulating element is inserted, and the first housing part and the second housing part together form a heating chamber adjacent to the at least one pocket, in which the base sections of the heat-conducting plates and the at least one PTC-heating element located between them, are arranged;

wherein the arms of the two heat-conducting plates at their ends adjacent to the base section have a greater distance from one another than at their free ends.

* * * * *